US009431165B2

(12) United States Patent
Ukai et al.

(10) Patent No.: US 9,431,165 B2
(45) Date of Patent: Aug. 30, 2016

(54) INDUCTOR

(71) Applicant: MURATA MANUFACTURING CO., LTD., Kyoto (JP)

(72) Inventors: Hiroyuki Ukai, Nagaokakyo (JP); Akihiro Hayakawa, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 14/887,504

(22) Filed: Oct. 20, 2015

(65) Prior Publication Data

US 2016/0118184 A1 Apr. 28, 2016

(30) Foreign Application Priority Data

Oct. 23, 2014 (JP) ..... 2014-216488

(51) Int. Cl.

| | |
|---|---|
| ***H01F 27/29*** | (2006.01) |
| ***H01F 27/28*** | (2006.01) |
| ***H01F 17/04*** | (2006.01) |
| ***H01F 27/24*** | (2006.01) |

(52) U.S. Cl.

CPC ..... *H01F 27/29* (2013.01); *H01F 27/24* (2013.01); *H01F 27/2823* (2013.01)

(58) Field of Classification Search

None

See application file for complete search history.

(56) References Cited

U.S. PATENT DOCUMENTS

| | | | | |
|---|---|---|---|---|
| 2,930,014 A * | 3/1960 | Van Der Hoek | H01F 41/086 | 140/92.2 |
| 7,051,770 B2 * | 5/2006 | Sasaki | H01F 41/082 | 140/92.1 |
| 7,614,579 B2 * | 11/2009 | Asano | H01F 41/082 | 242/437.3 |
| 8,191,240 B2 * | 6/2012 | Ishido | H01F 17/045 | 264/272.11 |
| 2006/0196984 A1 * | 9/2006 | Higeta | H01F 27/2823 | 242/176 |
| 2008/0309445 A1 * | 12/2008 | Suzuki | H01F 41/069 | 336/183 |
| 2009/0045902 A1 * | 2/2009 | Hirai | H01F 17/045 | 336/192 |
| 2010/0109827 A1 * | 5/2010 | Asou | H01F 17/045 | 336/192 |
| 2014/0097928 A1 * | 4/2014 | Tomonari | H01F 27/28 | 336/207 |
| 2014/0167903 A1 * | 6/2014 | Tomonari | H01F 17/045 | 336/220 |

FOREIGN PATENT DOCUMENTS

JP 2005-044858 A 2/2005

* cited by examiner

*Primary Examiner* — Elvin G Enad
*Assistant Examiner* — Ronald Hinson
(74) *Attorney, Agent, or Firm* — Studebaker & Brackett PC

(57) ABSTRACT

An inductor including: a core having a winding core portion for winding a winding wire and two flange portions disposed on both ends of the winding core portion; and a winding wire wound around the winding core portion for multiple layers, the winding wire including: a forward winding layer having multiple turns on the winding core portion along a forward direction from one of the two flange portions toward the other flange portion; a backward winding layer following the forward winding layer and having at least one turn on the forward winding layer along a backward direction opposite to the forward direction; and a return winding portion following the backward winding layer and passing over the backward winding layer in the forward direction to reach the winding core portion on the forward direction side of the forward winding layer within less than 1/2 turn.

9 Claims, 6 Drawing Sheets

INDUCTOR

CROSS REFERENCE TO RELATED APPLICATIONS

This application claims benefit of priority of Japanese Patent Application No. 2014-216488 filed Oct. 23, 2014, the entire content of which is incorporated herein by reference.

TECHNICAL FIELD

The present disclosure relates to an inductor having a winding wire wound in multiple layers used in a mobile communication device such as a portable telephone, a smartphone, and a tablet.

BACKGROUND

Inductors used in, for example, noise reduction and high-frequency suppression filters are recently further reduced in size in mobile communication devices such as a portable telephone, a smartphone, and a tablet. Therefore, when a winding wire is wound in layers around a winding core portion to make up an inductor, a thickness of the layers, i.e., a winding layer thickness of the winding wire must further be suppressed.

For example, a coil component is known that has a winding wire wound in a winding method designed to suppress a winding layer thickness of the winding wire of the coil component (see, e.g., Japanese Laid-Open Patent Publication No. 2005-044858).

In the coil component described above, for example, if a winding wire is wound in first and second layers around a winding core portion and returned from the second layer to the winding core portion for a long distance, a return winding portion may deteriorate in shape stability and more turns may be required for the return winding.

SUMMARY

An object of the present disclosure is to provide an inductor having a return winding portion in multilayer winding improved in shape stability.

In one general aspect, the techniques disclosed here feature: an inductor comprising:

a core having a winding core portion for winding a winding wire and two flange portions disposed on both ends of the winding core portion; and a winding wire wound around the winding core portion for multiple layers, the winding wire including:

- a forward winding layer having multiple turns on the winding core portion along a forward direction from one of the two flange portions toward the other flange portion;
- a backward winding layer following the forward winding layer and having at least one turn on the forward winding layer along a backward direction opposite to the forward direction; and
- a return winding portion following the backward winding layer and passing over the backward winding layer in the forward direction to reach the winding core portion on the forward direction side of the forward winding layer within less than ½ turn.

An inductor according to the present disclosure is characterized by a return winding portion of a winding wire in a multilayer winding configured to reach a winding core portion on the forward direction side within less than ½ turn. As a result, the return winding portion can be stabilized in multilayer winding.

Additional benefits and advantages of the disclosed embodiments will be apparent from the specification and figures. The benefits and/or advantages may be individually provided by the various embodiments and features of the specification and drawings disclosure, and need not all be provided in order to obtain one or more of the same.

BRIEF DESCRIPTION OF THE DRAWINGS

The present disclosure will become readily understood from the following description of non-limiting and exemplary embodiments thereof made with reference to the accompanying drawings, in which like parts are designated by like reference numeral and in which.

DETAILED DESCRIPTION

Figure 1:
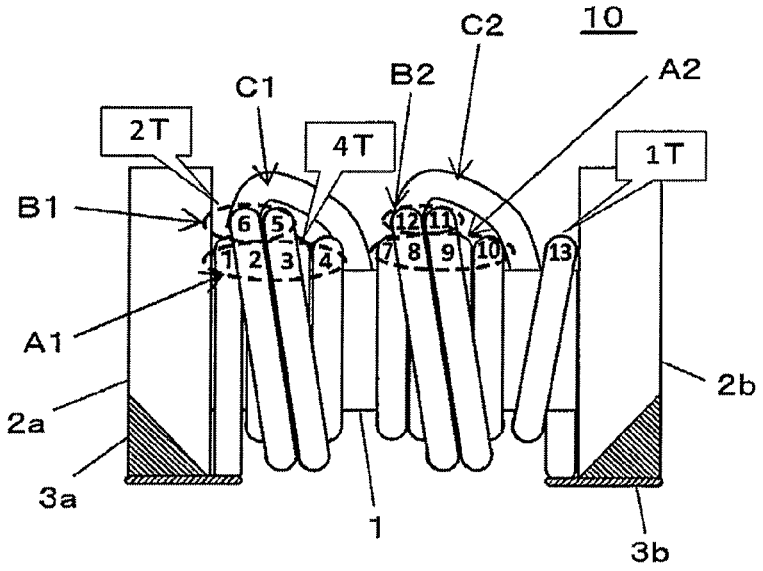
FIG. 1 is a view of one lateral surface of a state of a winding wire when a bottom surface is a surface having an external electrode disposed on a flange portion of a core of an inductor according to a first embodiment.

According to a first aspect, an inductor includes:

a core having a winding core portion for winding a winding wire and two flange portions disposed on both ends of the winding core portion; and a winding wire wound around the winding core portion for multiple layers, the winding wire including a forward winding layer having multiple turns on the winding core portion along a forward direction from one of the two flange portions toward the other flange portion, a backward winding layer following the forward winding layer and having at least one turn on the forward winding layer along a backward direction opposite to the forward direction, and a return winding portion following the backward winding layer and passing over the backward winding layer in the forward direction to reach the winding core portion on the forward direction side of the forward winding layer within less than ½ turn.

Further, as an inductor of a second aspect, in the first aspect, the winding wire may further include a portion of at least one turn following the return winding portion on the winding core portion on the forward direction side.

Further, as an inductor of a third aspect, in the first aspect, the return winding portion may pass over the backward winding layer and reach the winding core portion within ¼ turn or less.

Further, as an inductor of a fourth aspect, in the first aspect, the winding core portion may have a rectangular cross-sectional shape.

Further, as an inductor of a fifth aspect, in the first aspect, each flange portion has a rectangular outer shape and has an external electrode on one side of the rectangle of the flange portion.

Further, as an inductor of a sixth aspect, in the first aspect, when a surface having the external electrode is defined as a bottom surface, the return winding portion may be disposed on a top surface side opposite to the bottom surface.

Further, as an inductor of a seventh aspect, in the first aspect, when a surface having the external electrode is defined as a bottom surface, the return winding portion may be disposed on a lateral surface side adjacent to the bottom surface.

Further, as an inductor of a eighth aspect, in the first aspect, the inductor may have at least one or more sets of a backward winding layer having multiple turns and a forward winding layer having multiple turns between the forward winding layer having multiple turns on the winding core portion along the forward direction and the backward winding layer immediately before the return winding portion.

Further, as an inductor of a ninth aspect, in the first aspect, when the forward winding layer is defined as a first forward winding layer and the backward winding layer is defined as a first backward winding layer, the winding wire further may include a second forward winding layer following the return winding portion and having multiple turns on the winding core portion along the forward direction, a second backward winding layer following the second forward winding layer and having at least one turn on the second forward winding layer along a backward direction opposite to the forward direction, and a second return winding portion following the second backward winding layer and passing over the second backward winding layer in the forward direction to reach the winding core portion subsequent to the second forward winding layer within less than ½ turn.

An inductor according to an embodiment of the present disclosure will now be described with reference to the accompanying drawings. In the drawings, substantially the same members are denoted by the same reference numerals.

Knowledge Underlying This Disclosure

When an inductor is formed by winding a winding wire around a winding core portion in multiple layers, "bank winding" generally refers to a method of winding including, for example, winding the winding wire in a first layer around the winding core portion, then winding the subsequent winding wire as a second layer on the winding wire of the first layer, and repeating such a winding wire pattern. The present inventor found that if a complicated bank winding method is employed with a winding method and the number of turns varied as needed in the first and second layers, a winding layer thickness of the winding wire largely varies, resulting in large variations in inductance value. Specifically, when the bank winding is performed in an even-numbered layer, a return winding occurs for returning to the forward direction. The present inventor found a problem that a winding layer thickness of the winding wire in a return winding portion is not stabilized due to a factor such as being affected by the winding wire of an underlying layer in prior art, thereby causing large variations in induction value. For example, in a structure having a winding wire of a third layer disposed as a return winding portion in the forward direction on a second layer that is an even-numbered layer, if fluctuation occurs in the winding layer thickness of the winding wire of the second layer that is the underlying layer of the third layer, fluctuation may tend to occur in the winding layer thickness of the winding wire also in the third layer.

The present inventor found that when the return winding portion in multilayer winding is configured to reach a winding core portion on the forward direction side within less than ½ turn, the return winding portion can be stabilized, thereby achieving a configuration of the inductor according to the present disclosure.

First Embodiment

Inductor

Figure 2:
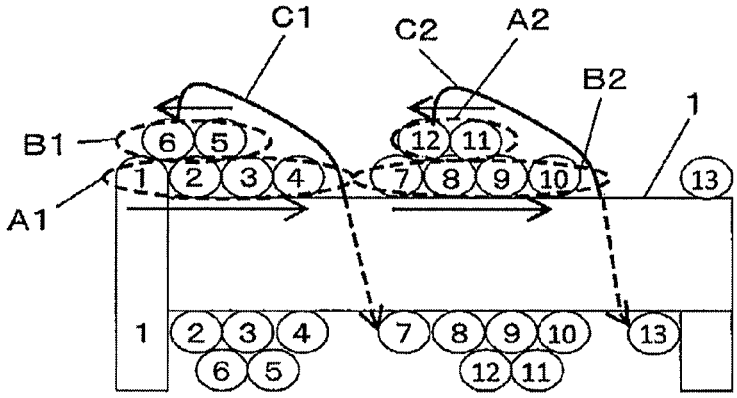
FIG. 2 is a schematic view of the order of the winding wire of FIG. 1.
Figure 3:
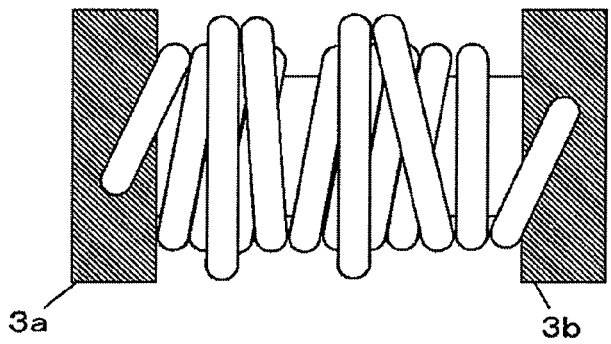
FIG. 3 is a bottom view of the state of the winding wire when the bottom surface is the surface having the external electrode disposed on the flange portion of the core of the inductor according to the first embodiment.
Figure 4:
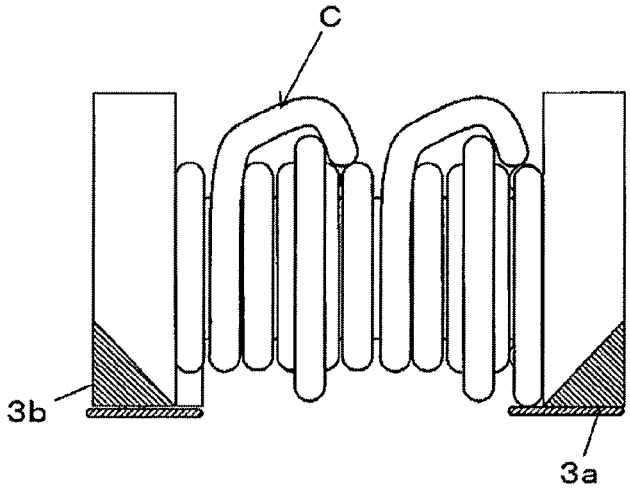
FIG. 4 is a view of the other lateral surface of the state of the winding wire when the bottom surface is the surface having the external electrode disposed on the flange portion of the core of the inductor according to the first embodiment.
Figure 5:
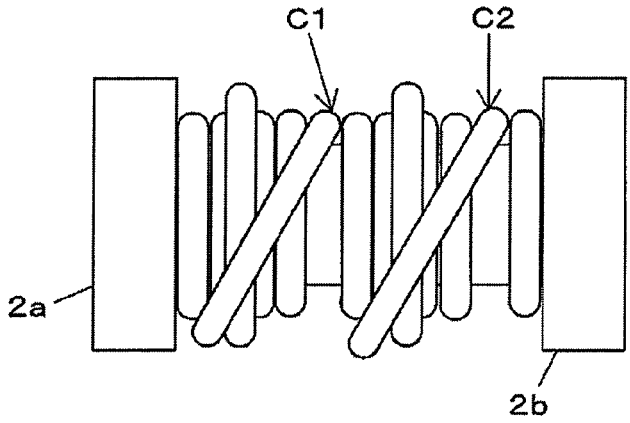
FIG. 5 is a plan view of the state of the winding wire when the bottom surface is the surface having the external electrode disposed on the flange portion of the core of the inductor according to the first embodiment.
Figure 6:
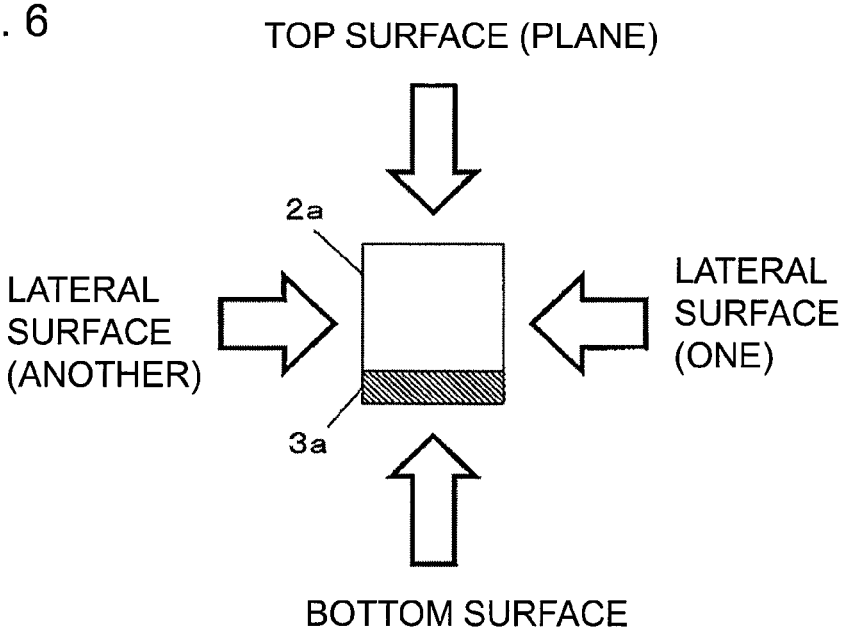
FIG. 6 is a front view of a winding core portion of the core of the inductor according to the first embodiment viewed in a longitudinal direction.
Figure 7:
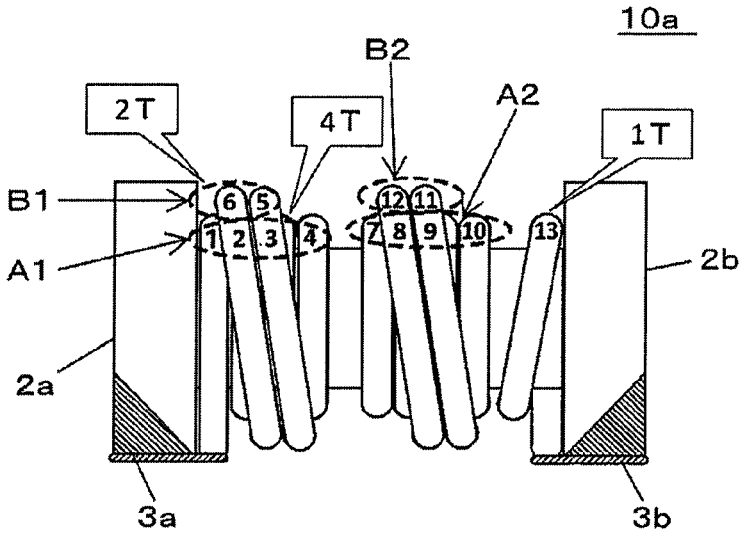
FIG. 7 is a view of one lateral surface of a state of a winding wire when a bottom surface is a surface having an external electrode disposed on a flange portion of a core of an inductor according to a second embodiment.
Figure 8:
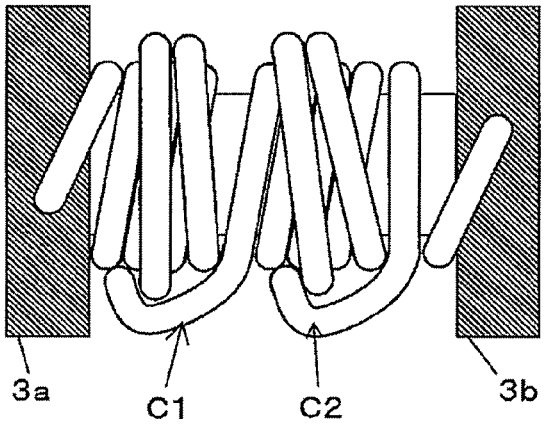
FIG. 8 is a bottom view of the state of the winding wire when the bottom surface is the surface having the external electrode disposed on the flange portion of the core of the inductor according to the second embodiment.
Figure 9:
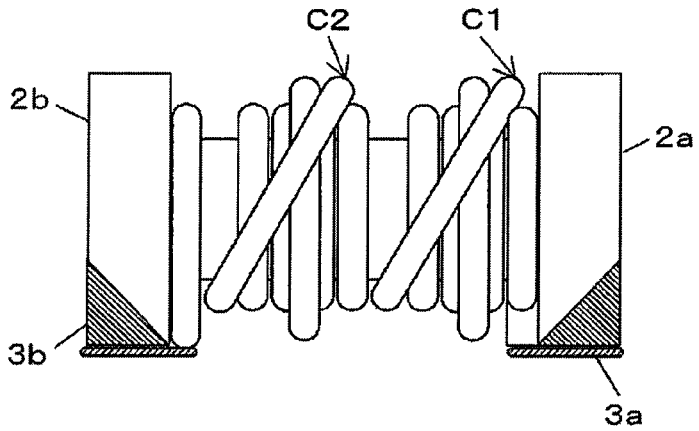
FIG. 9 is a view of the other lateral surface of the state of the winding wire when the bottom surface is the surface having the external electrode disposed on the flange portion of the core of the inductor according to the second embodiment.
Figure 10:
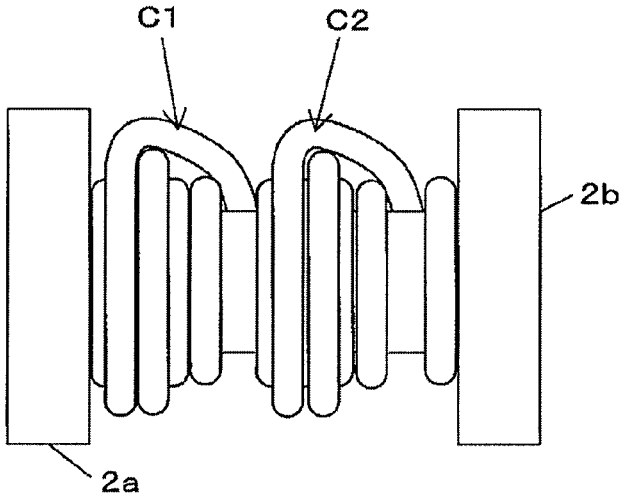
FIG. 10 is a plan view of the state of the winding wire when the bottom surface is the surface having the external electrode disposed on the flange portion of the core of the inductor according to the second embodiment.

FIG. 1 is a view of one lateral surface of a state of a winding wire when a bottom surface is a surface having an external electrode 3*a*, 3*b* disposed on a flange portion 2*a*, 2*b* of a core of an inductor 10 according to a first embodiment. FIG. 2 is a schematic view of the order of the winding wire of FIG. 1. FIGS. 3 to 5 are a bottom view, a view of the other lateral surface, and a plane view, respectively, of the state of the winding wire. FIG. 6 is a front view of a winding core portion 1 of the core of the inductor 10 according to the first embodiment viewed in a longitudinal direction. FIG. 1 and FIGS. 3 to 5 correspond to views from respective surfaces indicated by arrows of FIG. 6.

As depicted in FIGS. 1 to 5, this inductor 10 is the inductor 10 formed by winding a winding wire around a winding core portion 1 for multiple layers. The inductor 10 includes a core having a winding core portion 1 for winding the winding wire and two flange portions 2*a*, 2*b* disposed on both ends of the winding core portion 1, and the winding wire (conductive wire) wound around the winding core portion 1 for multiple layers. The winding wire includes a forward winding layer A1, A2 having multiple turns on the winding core portion 1 along a forward direction from one flange portion toward the other flange portion of the two flange portions, a backward winding layer B1, B2 following the forward winding layer A1, A2 and having at least one turn on the forward winding layer A1, A2 along a backward direction opposite to the forward direction, and a return winding portion C1, C2 following the backward winding layer B1, B2 and passing over the backward winding layer B1, B2 in the forward direction to reach the winding core portion 1 on the forward direction side of the forward winding layer A1, A2 within less than ½ turn. When a direction from the flange portion 2*a* toward the flange portion 2*b* is the forward direction, the forward winding layer A1, A2 is a first-layer winding wire portion (windings 1 to 4; four turns (4T)) wound adjacently in series along the forward direction. The backward winding layer B1, B2 is a second-layer winding wire portion (windings 5 to 6; two turns (2T)) wound adjacently in series along the backward direction opposite to the forward direction. The return winding portion C1, C2 is a portion (windings 6 to 7, 12 to 13) extending from the last turn (winding 6, 12) of the backward winding layer B1, B2 in the forward direction and passing over the backward winding layer B1, B2 (winding 5, 11) to reach the winding core portion 1 on the forward direction side of the forward winding layer A1, A2 (winding 4, 10). The return winding portion C1, C2 partially includes a third layer passing over the backward winding layer B1, B2 (winding 5, 11).

This inductor 10 has a feature of the return winding portion C1, C2 configured to reach the winding core portion 1 within less than ½ turn. In particular, the last turn (turn) is wound onto the winding core portion 1 and is therefore not affected by the winding wire of the underlying layer. Additionally, even if winding is loosened at the last portion of winding due to plastic deformation of the winding wire itself at the time of pressure bonding of the winding wire, since the last turn of the return winding portion C1, C2 is wound on the winding core portion 1, the winding wire is restrained from protruding from the plane of the flange portions 2*a*, 2*b*. As a result, the return winding portion C1, C2 can be stabilized in a multilayer winding. This enables a reduction of variations in inductance value due to the winding wire. Because of the restraining effect to a protruding portion, a risk of breaking of wire can be suppressed in a manufacturing process or at the time of mounting at a customer site.

Because of the configuration of the winding wire extending from the return winding portion C2 to reach (drop down) to the first-layer winding core portion 1 on the forward direction side and subsequently wound around the winding core portion 1 at least once (one turn (1T)), the last bank winding portion of a plurality of bank winding portions can be formed in a structure equivalent to the other bank winding portions. This point also enables suppression of characteristic variations. Moreover, since the return winding portion is dropped down onto the winding core portion 1 before the subsequent winding wire, the portions of the winding wire before and after the return winding portion can be stabilized as respective separate portions.

Since the number of turns of the return winding portion is less than ½, the number of turns can be made smaller and an increase in direct current resistance value due to return winding can be suppressed. Since the number of turns (turn number) of the return winding portions C1, C2 is less than ½, a work length of the winding wire on an apparatus can be shortened to suppress the occurrence of unexpected interference of equipment such as contact with another member on the apparatus occurring in the case of longer work length.

As depicted in FIGS. 1 to 5, in this inductor 10, a third-layer portion of the return winding portion C1, C2 passes over the second-layer backward winding layer B1, B2 only on one surface that is the top surface, i.e., within ¼ turn or less, so that an increase in winding layer thickness of the winding wire can be suppressed. Since the third-layer portion of the return winding portion is located only on one surface, a winding state can be kept constant and, therefore, the tolerance of the acquirable inductance value can be made smaller.

Moreover, since the inductor 10 has no return winding portion between the first layer and the second layer, variations of an inductance L value in the second layer are reduced.

Because of synergy of these effects, the stabilization of the inductance L value can be achieved to produce a highly reliable coil component.

Constituent members making up this inductor 10 will hereinafter be described.

Core

The core has the winding core portion 1 for winding the winding wire and the two flange portions 2*a*, 2*b* disposed on both ends of the winding core portion 1.

Winding Core Portion

The winding core portion 1 may be made of any commonly used material and may be made of, for example, a soft magnetic material such as ferrite. The longitudinal length of the winding core portion 1 is not particularly limited and may be within a range of 0.2 to 2.0 mm, for example. The cross-sectional shape of the winding core portion 1 may be a rectangular shape, a polygonal shape, or a circular shape, for example.

Flange Portion

The flange portions 2*a*, 2*b* are disposed on both ends of the winding core portion 1. The outer shape of the flange portions 2*a*, 2*b* may be a rectangular shape, a polygonal shape, or a circular shape, for example.

The flange portions 2*a*, 2*b* are disposed with the external electrodes 3*a*, 3*b*. If the outer shape of the flange portions 2*a*, 2*b* is a rectangular shape, the external electrodes 3*a*, 3*b* may be disposed on one side of the rectangular shape. If the outer shape of the flange portions 2*a*, 2*b* is a polygonal shape, the external electrodes 3*a*, 3*b* may be disposed on one side thereof. If the outer shape of the flange portions 2*a*, 2*b* is a circular shape, the external electrodes 3*a*, 3*b* may be disposed on a chord having a suitable length.

A step height defined as a diameter difference between the flange portions 2*a*, 2*b* and the winding core portion 1 is made larger than a value acquired by multiplying the maximum diameter of the conductive wire making up the winding wire by the number of layers of the winding wire so as not to protrude from the windings. For example, the step height between the flange portions 2*a*, 2*b* and the winding core portion 1 is set larger than a value acquired by multiplying the maximum diameter of the conductive wire by the multiplier equal to the maximum layer number such as three and four when the number of layers including the return winding portion is three and four, respectively.

As a result, the winding wire can be prevented from protruding from the flange portions 2*a*, 2*b* and the breaking of wire can be avoided at the time of mounting.

The height of the portion of flange portions 2*a*, 2*b* corresponding to the surface disposed with the return winding portions C1, C2 may be made higher than the height of other portions of the flange portions 2*a*, 2*b* corresponding to the other surfaces.

A step ratio between diameter of the flange portions 2*a*, 2*b* and diameter of the winding core portion 1 is represented by a flange portion step ratio={(flange portion outer diameter−winding core portion diameter)/((flange portion outer diameter)*2)}×100 (%). This flange portion step ratio may be set to 20% or less, for example. If this flange portion step ratio exceeds 20%, the density of the flange portions becomes low and unstable in a press process at the time of manufacturing of the flange portions 2*a,* 2*b* and the manufacturing stability of the winding core portion 1 itself deteriorates and may cause breaking of the flange portions 2*a,* 2*b* during winding the wire. In contrast, if the ratio is 20% or less, the formability becomes stable and the deterioration in core strength can be prevented to achieve production stability.

Winding Wire

The winding wire (for example, the conductive wire, the wire) is wound around the winding core portion 1 for multiple layers. The winding wire includes the forward winding layer A1, A2 having multiple turns on the winding core portion 1 along the forward direction, the backward winding layer B1, B2 having at least one turn on the forward winding layer A1, A2 along the backward direction opposite to the forward direction, and the return winding portion C1, C2 returned from the last turn of the backward winding layer B1, B2 is to the forward direction to pass over the backward winding layer B1, B2 within less than ½ turn before being wound around the winding core portion 1 on the forward direction side of the forward winding layer A1, A2.

The return winding portion C1, C2 preferably passes over the backward winding layer B1, B2 within ¼ turn or less before being wound around the winding core portion 1.

When a surface having the external electrode 3*a,* 3*b* is defined as a bottom surface, the return winding portion C1, C2 may be disposed on the top surface side opposite to the bottom surface. Alternatively, as described later in a second embodiment, the return winding portion C1, C2 may be disposed on a lateral surface side adjacent to the bottom surface. If the top surface is coated with a resin to mount the inductor 10, the return winding portion C1, C2 is preferably disposed on a lateral surface side adjacent to the bottom surface to prevent protrusion to the top surface.

At least one or more sets of a backward winding layer having multiple turns and a forward winding layer having multiple turns may be included between the forward winding layer A1, A2 having multiple turns on the winding core portion 1 along the forward direction and the backward winding layer B1, B2 immediately before the return winding portion C1, C2. For example, if a set of the backward winding layer and the forward winding layer is included between the forward winding layer A1, A2 and the backward winding layer B1, B2, the winding wire may include a total of five layers, which are the forward winding layer, the backward winding layer, the forward winding layer, the backward winding layer, and the return winding portion. Two sets or more may be included.

As depicted in FIG. 1 etc., the winding wire may include the second forward winding layer A2 following the return winding portion C1 and having multiple turns on the winding core portion 1 along the forward direction, the second backward winding layer B2 having at least one turn on the second forward winding layer A2 along the backward direction opposite to the forward direction, and the second return winding portion C2 configured to extend from the last turn of the second backward winding layer B2 to the winding core portion on the forward direction side and passing over the second backward winding layer B2 within less than one turn before being wound around the winding core portion 1 on the forward direction side of the second forward winding layer A2. Therefore, the winding wire may have a plurality of sets of the forward winding layers, the backward winding layers, and the return winding portions along the longitudinal direction of the winding core portion 1.

Second Embodiment

Inductor

Figure 11:
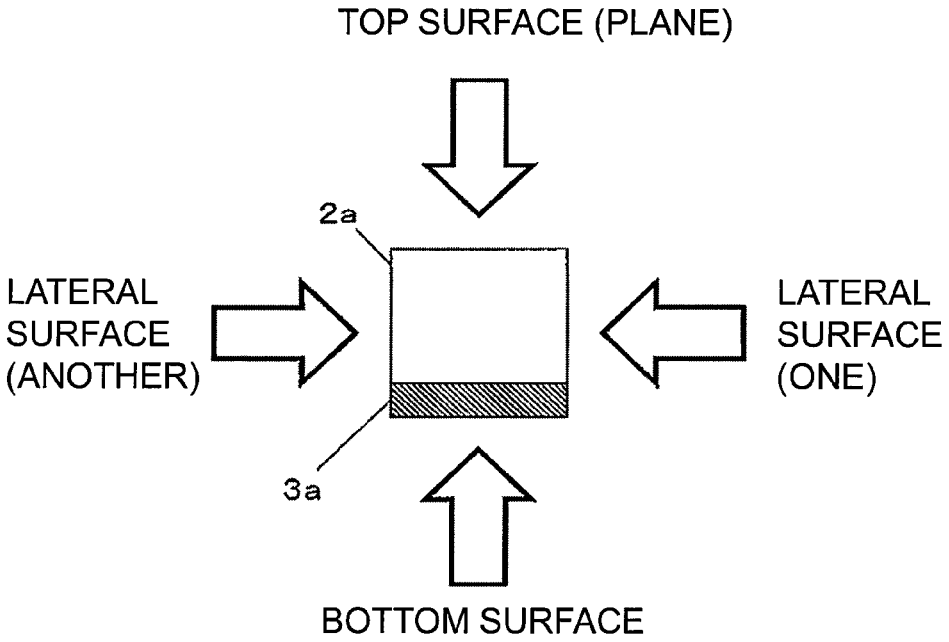
FIG. 11 is a front view of a winding core portion of the core of the inductor according to the second embodiment viewed in a longitudinal direction.

FIGS. 7 to 10 are a view of one lateral surface, a bottom view, a view of the other lateral surface, and a plane view, respectively, of the state of the winding wire when a surface having the external electrode 3*a,* 3*b* disposed on the flange portion 2*a,* 2*b* of the core of an inductor 10*a* according to a second embodiment is defined as a bottom surface. FIG. 11 is a front view of the winding core portion 1 of the core of the inductor 10*a* according to the second embodiment viewed in the longitudinal direction. FIGS. 7 to 10 correspond to views from respective surfaces indicated by arrows of FIG. 11.

As compared to the inductor 10 according to the first embodiment, the inductor 10*a* according to the second embodiment is different in that the return winding portion C1, C2 is disposed on a lateral surface side adjacent to the bottom surface. Specifically, the return winding portion C1, C2 has the third-layer portion passing over the second-layer backward winding layer B1, B2 only on one surface on the lateral surface side, i.e., within ¼ turn or less, and therefore, an increase in thickness of the winding wire can be suppressed. Since the third-layer portion of the return winding portion C1, C2 is located only on one lateral surface, a winding state can be kept in a certain state and, therefore, the tolerance of the acquirable inductance value can be made smaller. Since the protrusion to the top surface is prevented, this is effective when the top surface is coated with a resin to mount the inductor 10.

In this disclosure, arbitrary embodiments of the various embodiments described above may be combined such that the effects of the respective embodiments can be produced.

The inductor according to the present disclosure is particularly characterized in that the return winding portion is configured to reach the winding core portion on the forward direction side within less than ½ turn. Since the return winding portion can consequently be stabilized in a multilayer winding, the dimensional tolerance of element size can be made extremely small. As a result, an element mounting area can be designed smaller to facilitate the design of disposition onto a circuit board with a limited mounting area. From the above, the inductor is useful for an inductor for a mobile communication device.

What is claimed is:

1. An inductor comprising:

a core having a winding core portion for winding a winding wire and two flange portions disposed on both ends of the winding core portion; and a winding wire wound around the winding core portion for multiple layers, the winding wire including a forward winding layer having multiple turns on the winding core portion along a forward direction from one of the two flange portions toward the other flange portion, a backward winding layer following the forward winding layer and having at least one turn on the forward winding layer along a backward direction opposite to the forward direction, and a return winding portion following the backward winding layer and passing over the backward winding layer in the forward direction to reach the winding core portion on the forward direction side of the forward winding layer within less than ½ turn.

2. The inductor of claim 1, wherein the winding wire further includes a portion of at least one turn following the return winding portion on the winding core portion on the forward direction side.

3. The inductor of claim 1, wherein the return winding portion passes over the backward winding layer and reaches the winding core portion within ¼ turn or less.

4. The inductor of claim 1, wherein the winding core portion has a rectangular cross-sectional shape.

5. The inductor of claim 1, wherein each flange portion has a rectangular outer shape and has an external electrode on one side of the rectangle of the flange portion.

6. The inductor of claim 5, wherein when a surface having the external electrode is defined as a bottom surface, the return winding portion is disposed on a top surface side opposite to the bottom surface.

7. The inductor of claim 5, wherein when a surface having the external electrode is defined as a bottom surface, the return winding portion is disposed on a lateral surface side adjacent to the bottom surface.

8. The inductor of claim 1, wherein the inductor has at least one or more sets of a backward winding layer having multiple turns and a forward winding layer having multiple turns between the forward winding layer having multiple turns on the winding core portion along the forward direction and the backward winding layer immediately before the return winding portion.

9. The inductor of claim 1, wherein when the forward winding layer is defined as a first forward winding layer and the backward winding layer is defined as a first backward winding layer, the winding wire further includes a second forward winding layer following the return winding portion and having multiple turns on the winding core portion along the forward direction, a second backward winding layer following the second forward winding layer and having at least one turn on the second forward winding layer along a backward direction opposite to the forward direction, and a second return winding portion following the second backward winding layer and passing over the second backward winding layer in the forward direction to reach the winding core portion subsequent to the second forward winding layer within less than ½ turn.

* * * * *